US006113252A

United States Patent [19]

Arlitt et al.

[11] Patent Number: 6,113,252

[45] Date of Patent: Sep. 5, 2000

[54] ARCHITECTURAL LUMINARIES

[75] Inventors: Mark L. Arlitt, Austin; William J. Luetkemeyer, Azle; Matthew B. Johnson, Dallas; Bryan S. McNatt, Plano; Mark Richards, Grand Prarie; Richard K. Steele, Lewisville, all of Tex.

[73] Assignee: Vari-Lite, Inc., Dallas, Tex.

[21] Appl. No.: 09/025,084

[22] Filed: Feb. 17, 1998

[51] Int. Cl.[7] ..... F21S 1/06

[52] U.S. Cl. ..... 362/365; 362/268; 362/277; 362/280; 362/281; 362/282; 362/283; 362/284; 362/319; 362/322; 362/323; 362/324

[58] Field of Search ..... 362/268, 277, 362/280, 281, 282, 283, 284, 319, 322, 323, 324

[56] References Cited

U.S. PATENT DOCUMENTS 5,590,955 1/1997 Bornhorst et al. ..... 362/324

*Primary Examiner*—Sandra O'Shea
*Assistant Examiner*—Ronald E. Delgizzi
*Attorney, Agent, or Firm*—Hughes & Luce, L.L.P.

[57] ABSTRACT

Architectural luminaries utilize a common optical engine having a lamp coupled to an ellipsoidal reflector, a field stop aperture, and image-projecting lenses A color wheel, gobo wheel, and mechanical dimmer may also be included. A microlens element converts a spotlight optical engine into a wash light optical system. A multiple lens array provides variable diffusion. The optical engine is combined with an X-Y scanning mirror beam direction system in a substantially recessed housing for mounting in the ceiling of a building. The optical engine is combined with a pan-and-tilt yoke for greater range of coverage with an exposed luminaire.

23 Claims, 9 Drawing Sheets

ARCHITECTURAL LUMINARIES

FIELD OF THE INVENTION

The present invention relates to lighting instruments and optical systems therefor, especially to a convertible optical system adaptable from a spot light projector to a wash light illuminator having variable diffusion property.

DESCRIPTION OF RELATED ART

Prior art lighting instruments are usually designed for a specific purpose, among those possible purposes being a spot light projector, a wash light or other general area illumination. A typical spot light, such as that shown in U.S. Pat. No. 2,076,240 to Levy, has an ellipsoidal reflector and a projection gate or field stop aperture with two or more lenses to produce a hard-edged beam capable of projecting a well-defined beam or projecting images of light pattern generators or gobos placed in the projection gate. A typical wash light, such as that shown in U.S. Pat. No. 3,428,800 to Levin, has a lamp and reflector that are movable with respect to a Fresnel lens to produce a soft-edged, ill-defined beam that produces a smooth wash of light with a variable beam diameter. A wash light typically has no gate aperture.

While an ellipsoidal reflector provides a region of minimal beam diameter near the secondary focus of the reflector, which can be advantageously used for beam shaping and the forming of images, and also for beam color control using small dichroic filters, projection lenses of a quality suitable for image projection provide only a limited range of beam divergence angles compared with Fresnel-type lenses, which are not suitable for image projection.

Whereas all automated lighting fixtures produced to date are exposed fixtures, a great many architectural lighting fixtures, especially those for indoor use, are typically recessed into the ceiling of a building. Although exposed fixtures, particularly those of the moving head variety, can cover a wider range of lighting direction, not being limited by the reduced range of motion of moving mirror types, recessed fixtures tend less to detract from the general appearance or environmental design of a room since they are largely concealed within the ceiling. It is difficult to anticipate the wants or needs of architectural lighting customers, and the development of a product for production can be both lengthy and costly. It is therefore desirable to be able to produce either spot lights or wash lights in recessed or exposed fixtures, all of which resulting from a development program that uses as many parts in common as possible.

SUMMARY OF THE INVENTION

The preferred embodiment provides a convertible optical system for a light projector, the optical system being easily configurable from a spot light projector to a wash light projector to a wash light projector with variable diffusion.

In accordance with one aspect of the present invention, a spot light projecting optical system comprising a light source optically coupled with an elliptical reflector, a field stop aperture, and an axially-translatable, image-projecting lens system is adapted to a wash light system by placing a wash lens in front of the lens system.

In accordance with another aspect of the present invention, the wash light system described above is configured for variable diffusion by placing an axially-translatable, multiple lens array between the field stop aperture and the lens system, which includes the wash lens and the axially-translatable, image-projecting lens system.

In an alternate embodiment, the combination of image-projecting lens system and wash lens is axially fixed and the multiple-lens array is made axially translatable.

In accordance with another aspect of the present invention, the convertible optical system herein described can be configured as an exposed, moving-head luminaire or as a recessed luminaire with motorized mechanisms and automated functions.

DETAILED DESCRIPTION

Figure 1:
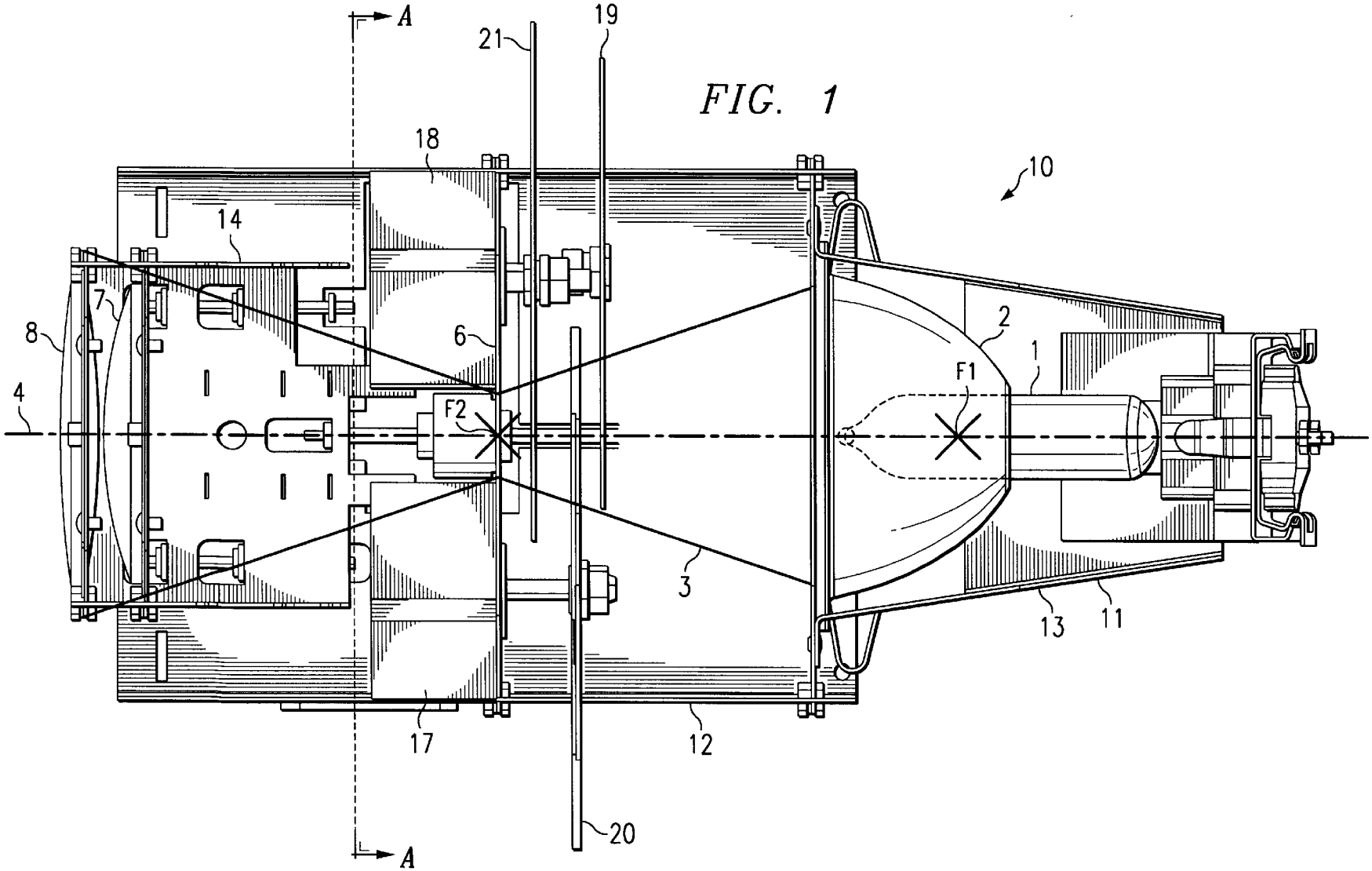
FIG. 1 is a plan view of the optical engine according to a first embodiment.
Figure 2:
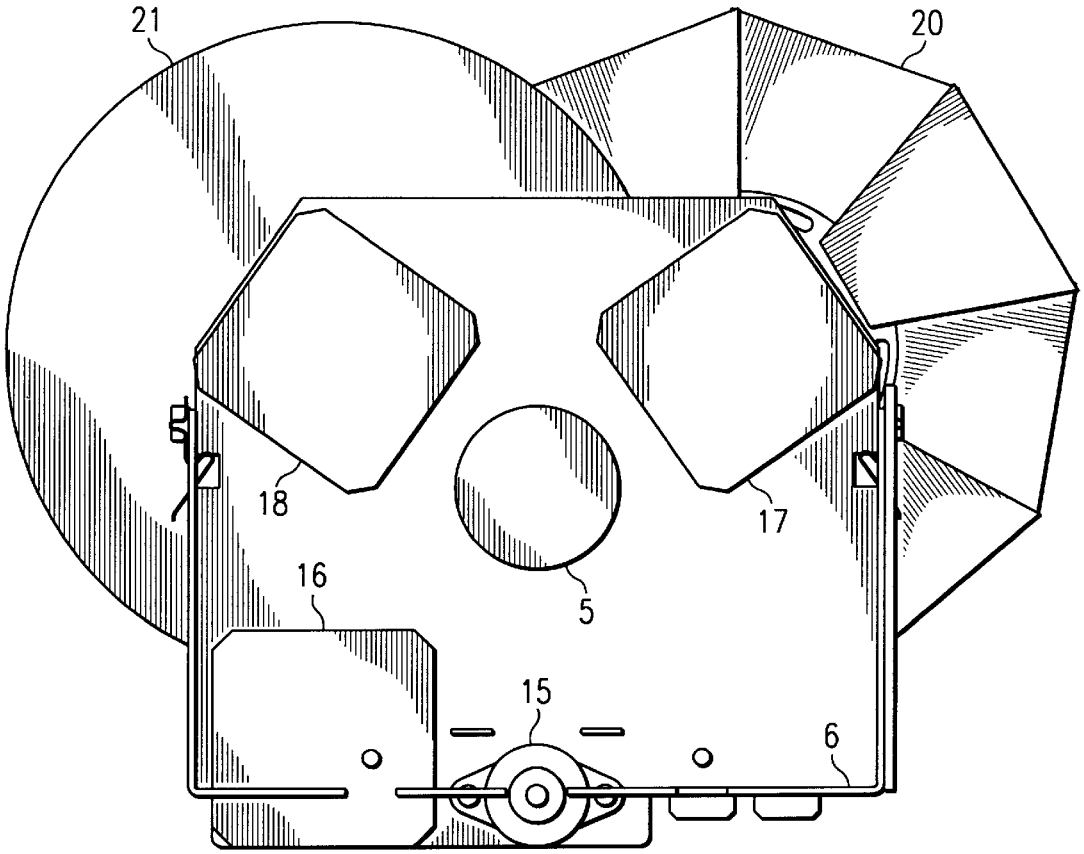
FIG. 2 is a cutaway view of the optical engine of the first embodiment through lines A—A.
Figure 3:
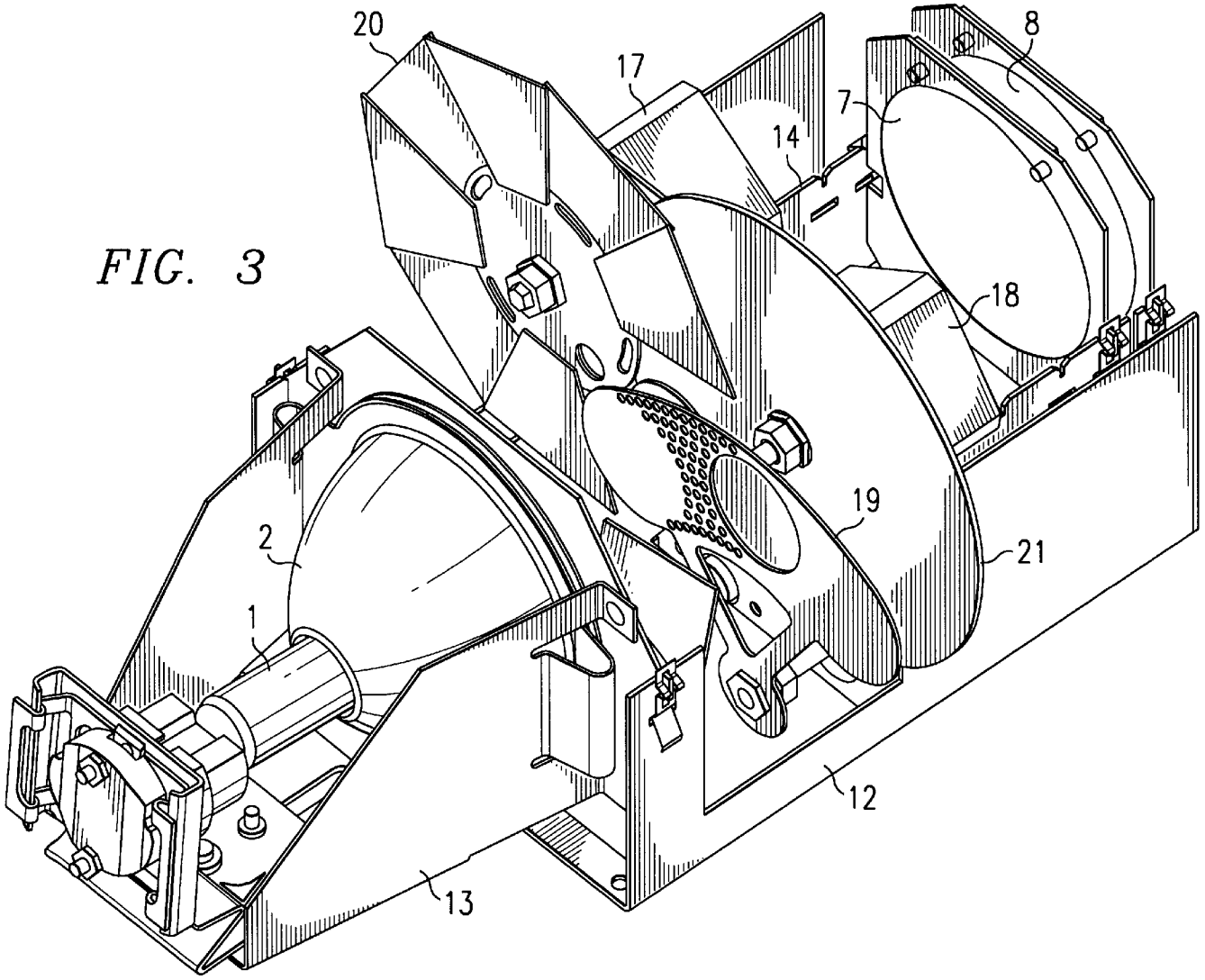
FIG. 3 is a perspective view of the optical engine of the first embodiment.

Lighting instruments disclosed herein are based upon a common optical engine. Referring to FIGS. 1–3, optical engine 10 includes a light source 1, such as an electric lamp, optically coupled to an ellipsoidal reflector 2 having a primary focus F1 and a secondary focus F2, the lamp and reflector forming a light beam 3 having an optical axis 4, the light beam converging at the secondary focus and diverging thereafter; a field stop aperture 5 formed in an aperture plate 6 located at the secondary focus; and image-projecting lenses 7 and 8 located along the optical axis downstream of the field stop aperture. The lamp, reflector, aperture plate and lenses are supported by a first frame assembly 11 that includes a main bracket 12, a lamp-support bracket 13, and a moveable lens carriage 14. The first frame assembly 11 maintains the lamp and reflector in substantially fixed relation to the aperture plate and allows the lenses to move axially along the optical axis with respect to the aperture plate, lamp and reflector for focusing the light beam at a desired throw length.

The lens carriage 14 can be manually adjusted and fixed in axial position by means of a suitable screw clamp arrangement, but is preferably coupled to a linear actuator motor 15 mounted on the aperture plate to enable remote adjustment via an electronic control system. Additional motors 16–18 can be mounted on the aperture plate for supporting an adjustable, mechanical dimmer 19, a rotatable color wheel 20, and a rotatable gobo wheel 21. An adjustable iris diaphragm (not shown) can also be mounted on the aperture plate and motorized to provide beam size adjustment.

The color wheel 20, gobo wheel 21, and mechanical dimmer 19 are preferably motorized as shown, for example, in U.S. Pat. No. 4,779,176; U.S. Pat. No. 4,800,474; and U.S. Pat. No. 5,590,954, which are hereby incorporated by reference. The motors are preferably operated by a suitable electronic control system of the type shown, for example in U.S. Pat. No. 4,392,187 and in U.S. Pat. No. 4,980,806, which are hereby incorporated by reference.

The optical engine 10 in the first embodiment, projects a beam of light which can be altered in color by the color wheel 20, can be altered in diameter by an adjustable iris diaphragm, can be altered pattern or shape by the gobo wheel 21, can be altered in intensity by the mechanical dimmer 19, and can be altered in focus by the proJection lens system. The optical engine 10 is mounted in a suitable enclosure which also contains control electronics for operating the motors, a power supply for energizing the lamp, and a power supply for energizing the control electronics. The enclosure provides features for mounting the lighting instrument in a desired location. A lighting instrument containing the optical engine may take a variety of forms, two of which will be described here.

Figure 4:
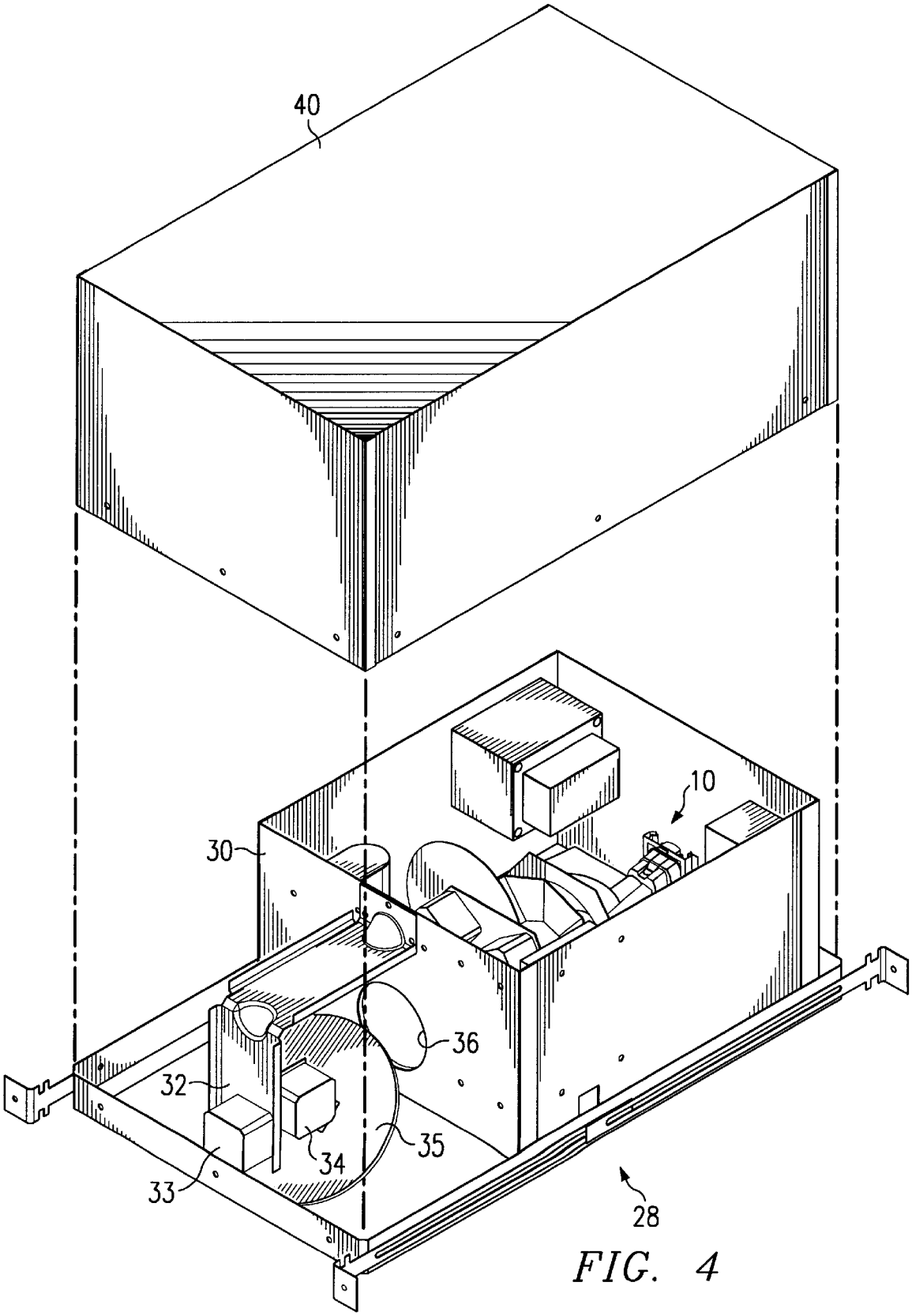
FIG. 4 is a partially-exploded, perspective view of a recessed luminaire.

As shown in FIG. 4, a recessed luminaire 28 includes the optical engine 10 mounted horizontally in a generally rectangular enclosure comprising a second frame 30 and a housing 40. The enclosure is preferably sized to fit within framing members of a suspended ceiling or between ceiling joists. A motorized X-Y scanning mirror is provided to intercept the light beam and variably re-direct the beam as desired. The motors are operated by the control electronics in a known manner. Scanning mirrors of this type are well-known and are shown, for example, in U.S. Pat. Nos. 3,594,566; 4,899,267; 5,089946; 5,333,102; in the international application WO 96/36834; and in U.K Patent Application No. GB 2 106 233 A, which are hereby incorporated by reference. The lighting instrument can be operated in any orientation and may, for example, be mounted substantially vertically within a wall if so desired.

Figure 5:
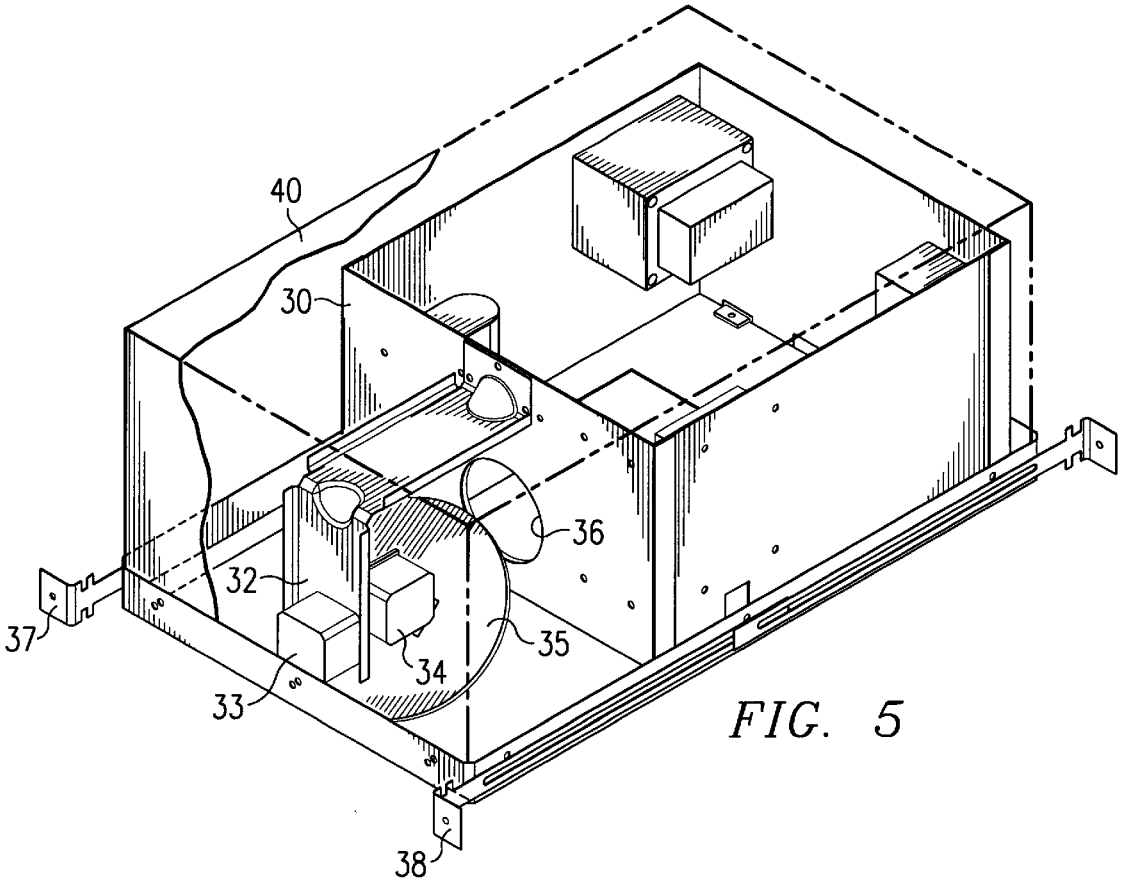
FIG. 5 is a perspective view of a housing for a recessed luminaire.

As shown in FIG. 5, a typical enclosure includes second frame 30 supporting an L-bracket 32 at one end thereof. A pan motor 33 supported on the L-bracket further supports a tilt motor 34, which in turn supports a planar, beam-steering mirror 35. Light from the optical engine passes though an aperture 36 formed in the second frame 30, and strikes the mirror 35, is adjusted in elevation via actuation of tilt motor 34, and is adjusted in azimuth via actuation of pan motor 33. Brackets 37 and 38 secure the enclosure within the ceiling of a building. Enclosure 40 surrounds the luminaire on five sides to protect the optical and mechanical components from particulate contamination, and to isolate electrical components from nearby building materials. Brackets 37 and 38 may be affixed to the second frame 30 as shown, or may alternatively be affixed to the housing 40 for mounting the housing into the ceiling as a first step, and then installing the rest of the luminaire assembled into the second frame 30 at a later time after the building construction and wiring installation has been accomplished.

Figure 7:
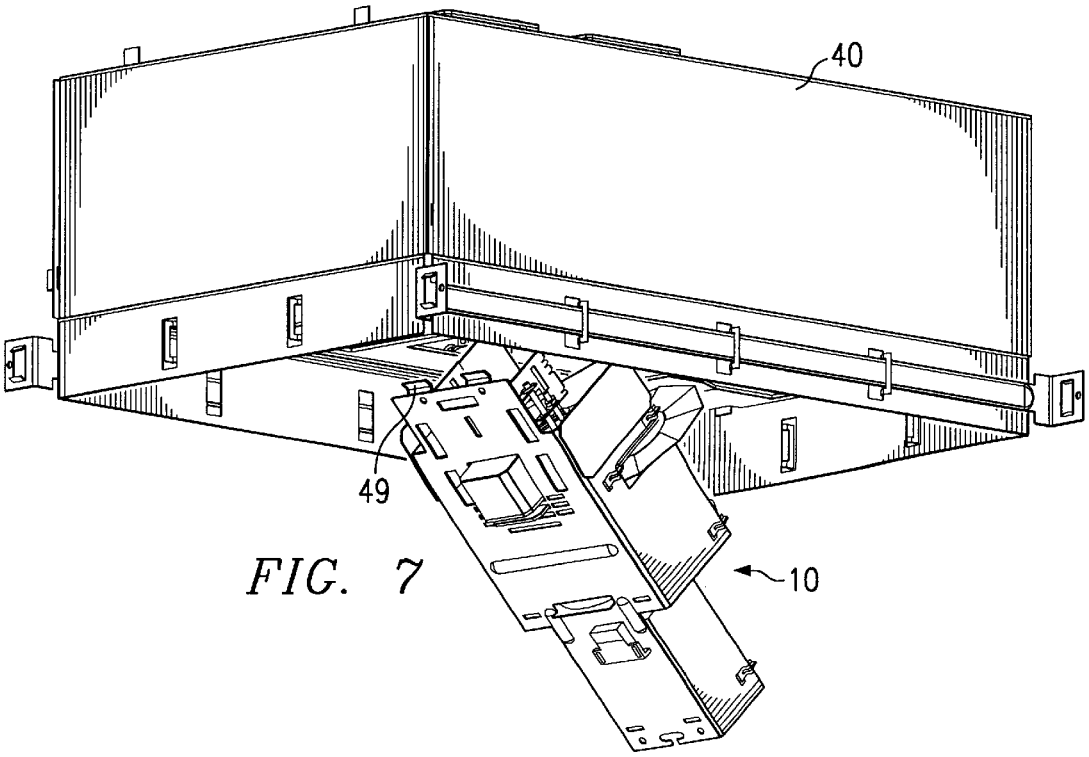
FIG. 7 is a perspective view of a recessed luminaire open for servicing.
Figure 6:
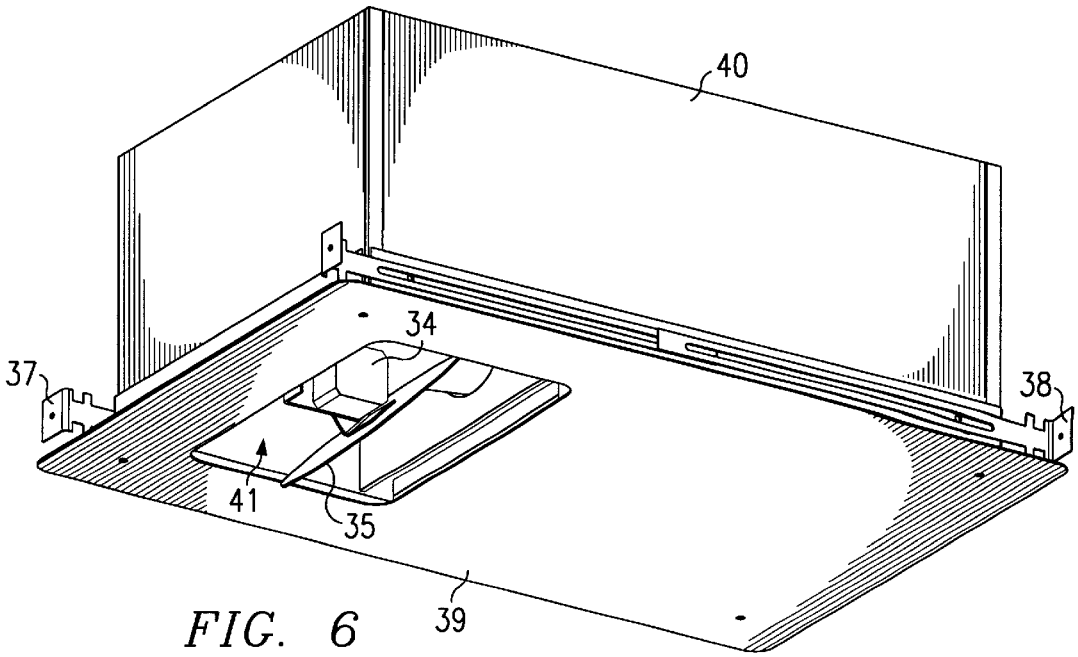
FIG. 6 is a perspective view of a recessed luminaire with cover.

As shown in FIG. 6, a cover plate 39 having an exit aperture 41 is installed over the recessed luminaire to conceal the inner workings from view, except for the mirror 35 and motor 34 which must necessarily be exposed to some extent for allowing the light beam to exit the enclosure. Since from time to time it will be necessary to replace the lamp and may be desirable to exchange the color wheel 20 or gobo wheel 21 for wheels having different color filters or different projectable images, the cover 39 can be removed and the optical engine 10 can be pivoted partially out of the enclosure into a maintenance position shown in FIG. 7. The first frame assembly 11 may be attached through a hinge device 49 to the second frame 30 to allow for the pivoting action. This maintenance position allows access to the lamp and to other optical, electrical or mechanical components of the optical engine 10.

Figure 8:
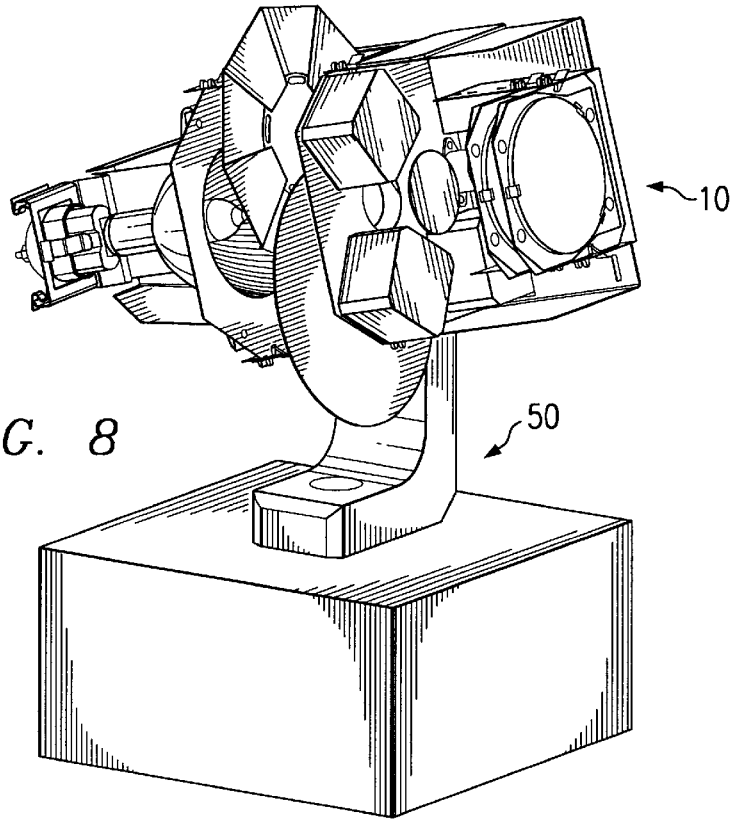
FIGS. 8 and 8A are perspective views of an exposed luminaire.
Figure 8A:
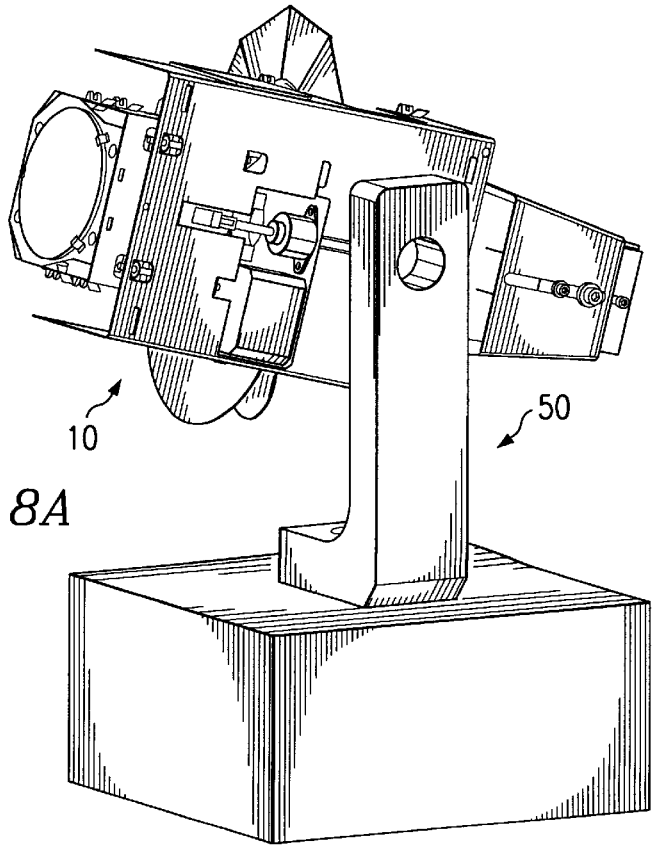

As shown in FIGS. 8 and 8A, the optical engine 10 can be mounted for pivotal motion in a motorized pan-and-tilt yoke 50. In practice, the optical engine would be enclosed by suitable and decorative covers, but the engine itself would be directly mounted to the yoke arm. Alternatively, a lamp housing structure could be mounted to the yoke and the optical engine could be installed in the lamp housing structure. Pan and tilt enclosures of this type are well-known and have been shown, for example, in U.S. Pat. Nos. 1,827,797; 3,209,136; 4,392,187; 4,701,833; 5,367,444; and 5,590,955, which are hereby incorporated by reference. The pan and tilt motors are operated by the control electronics in a known manner. Control and power supply electronics are mounted within the yoke arms and mounting enclosure as shown, for example, in U.S. Pat. Nos. 4,701,833 and 5,367,444, which are hereby incorporated by reference.

Thus, as described above, the basic optical engine 10 in a first, spot light, embodiment is used as a primary building block for creating a typical pan-and-tilt spot lighting instrument and is also used for creating a recessed spot lighting instrument utilizing an X-Y scanning mirror.

Figure 9:
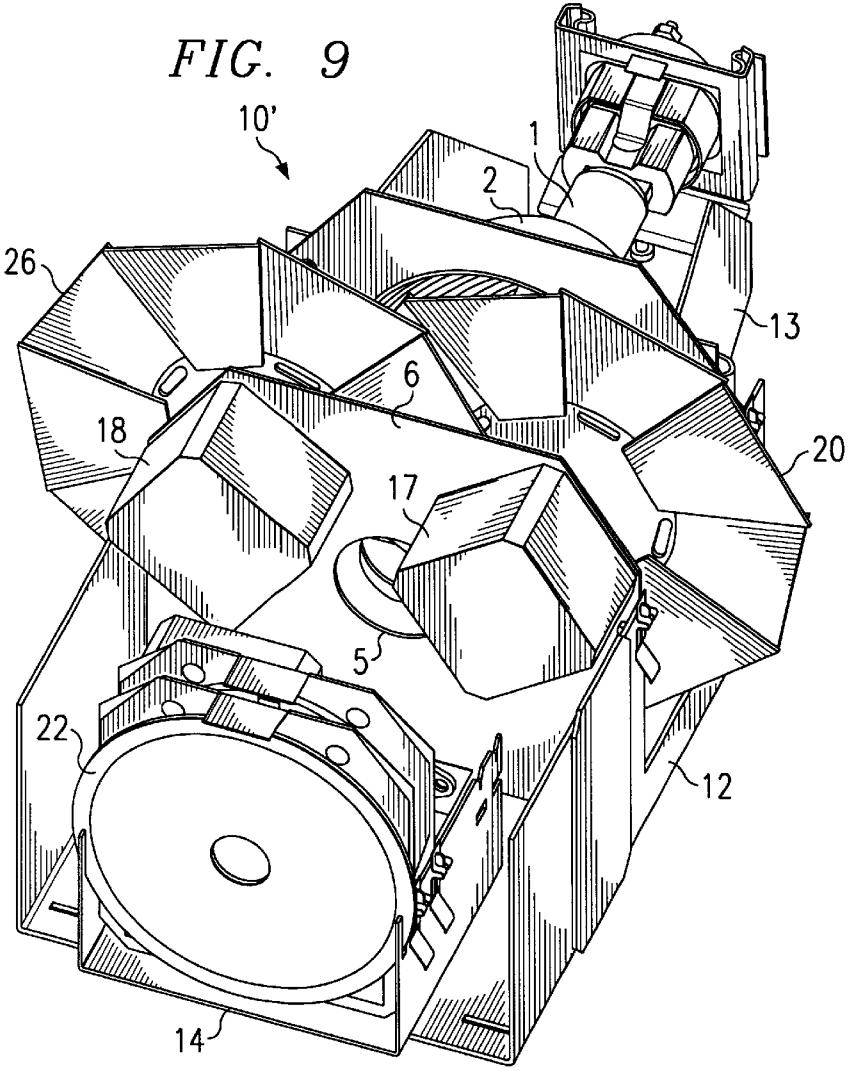
FIG. 9 is a perspective view of the optical engine according to a second embodiment.

Referring to FIG. 9, an optical engine 10' in a second embodiment further includes a micro-lens array 22 supported downstream of the projection lens system on the movable lens carriage 14. In this second, wash light, embodiment, the gobo wheel is preferably removed since projection of images is typically not an object of a wash light. The gobo wheel can be replaced by a second color wheel 26 for providing a wider range of colors such as described in U.S. Pat. No. 4,800,474, which is hereby incorporated by reference.

Figure 10:
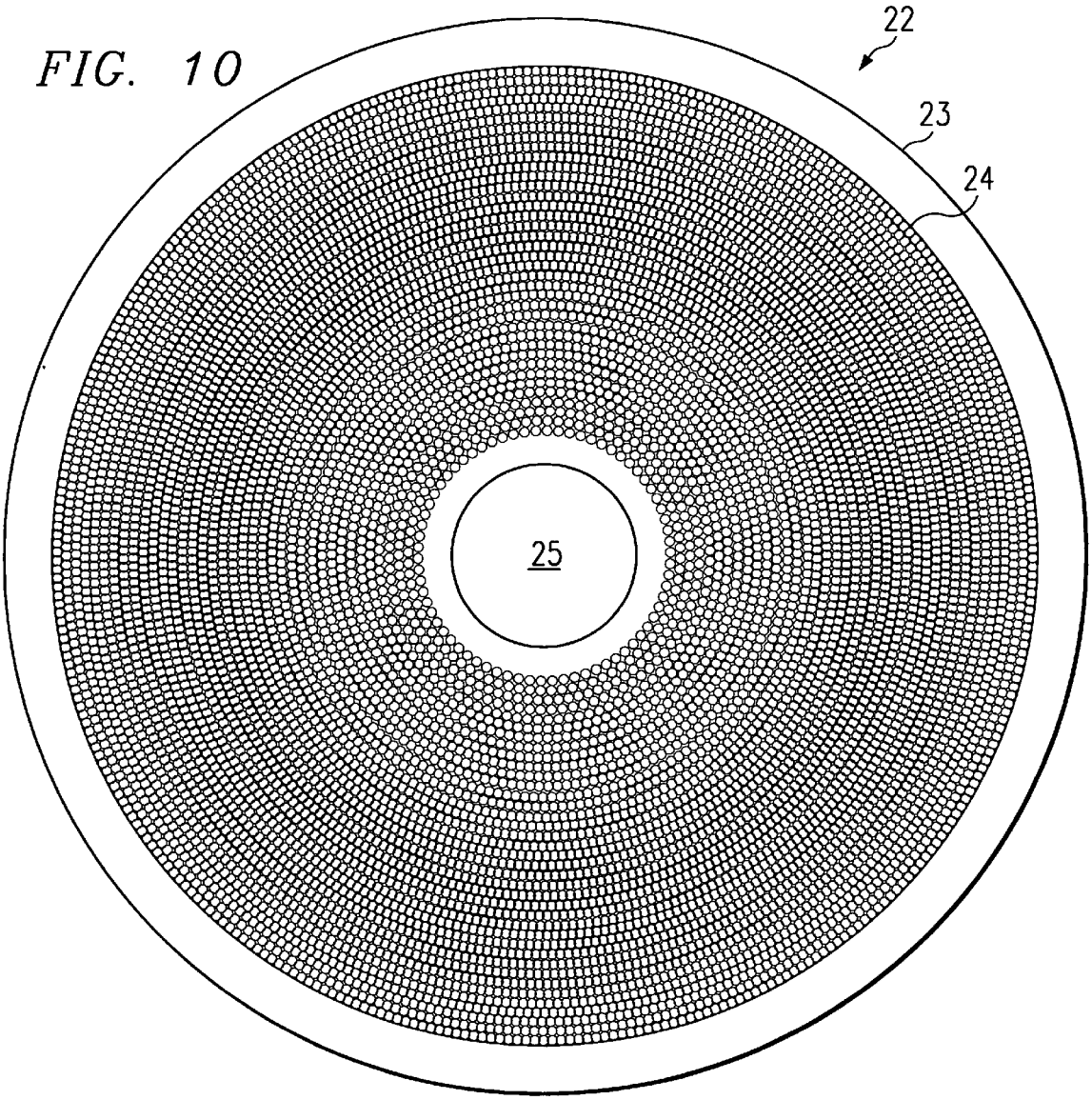
FIG. 10 is a plan view of a microlens.

The micro-lens array 22, as shown in FIG. 10, is preferably a clear disk 23 having a plurality of tiny convex lenslets 24 arranged in concentric circles on one face of the disk. Depending upon the size of the lenslets, the micro-lens array can provide any one of a variety of beam-angle dispersions; for example, 7.5 degree, 15 degree, or 30 degree beam angles. A mask 25 at the center of the disk blocks light rays radiating directly from the light source to prevent creation of a "hot spot" in the center of the beam. When mounted on the moveable lens carriage, downstream of the imaging lens system, the micro-lens array both enlarges the projected pool of light and softens the edges thereof. The actual beam angle can be varied somewhat, thereby varying the size of the pool of light, by adjusting the moveable lens carriage axially along the beam path.

The basic optical engine 10' in a second, wash light, embodiment is used as a primary building block for creating a typical pan-and-tilt wash lighting instrument and is also used for creating a recessed wash lighting instrument utilizing an X-Y scanning mirror as described above.

Figure 11:
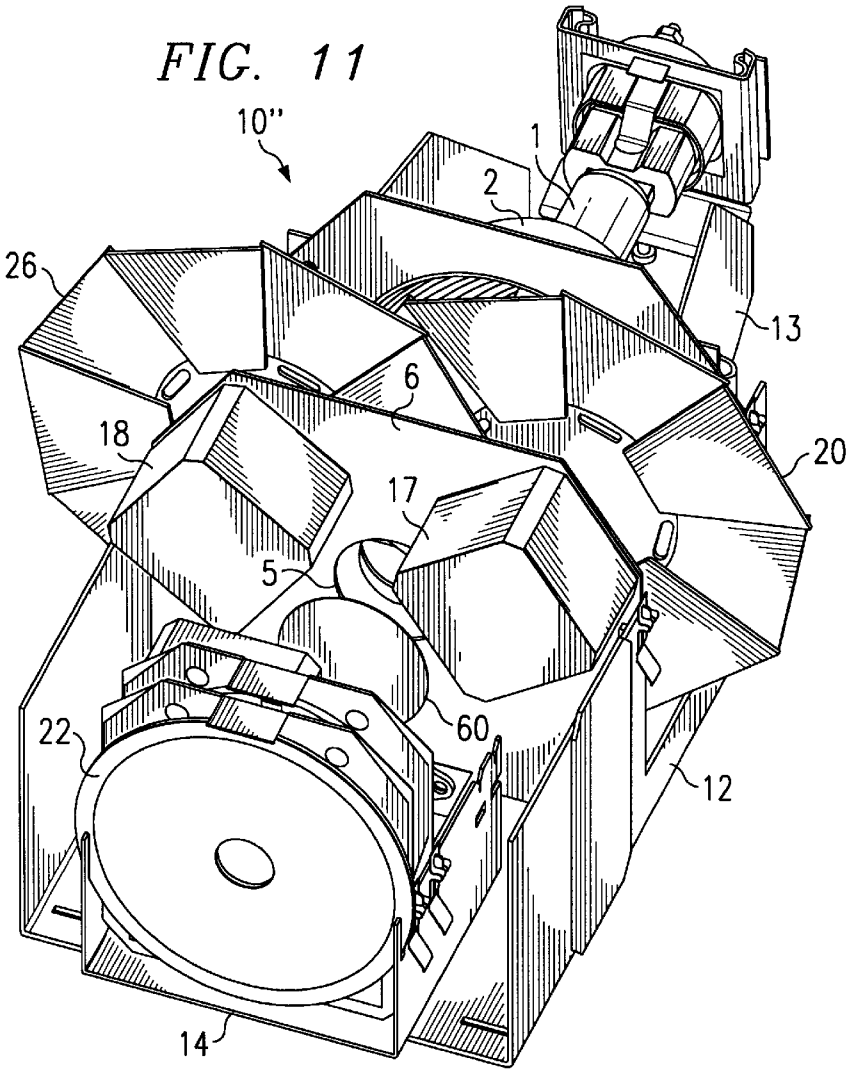
FIG. 11 is a perspective view of the optical engine according to a third embodiment.
Figure 12:
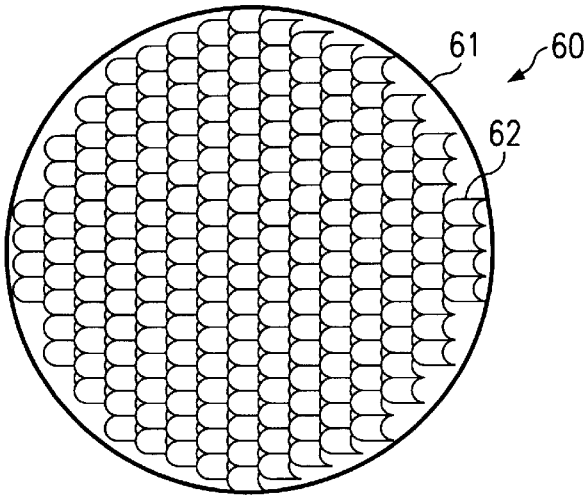
FIG. 12 is a perspective view of a multiple lens array.

Referring to FIG. 11, an optical engine 10" in a third, variable-diffusion wash light, embodiment includes a multiple-lens array 60 preferably positioned upstream of the imaging lens system. The multiple-lens array 60, as shown in FIG. 12, preferably comprises a transparent plate 61 having, on at least one surface thereof, a plurality of convex lenslets 62 of cylindrical or other shapes in geometric or other arrangement for increasing divergence of light rays passing therethrough. The multiple-lens array 60 can be mounted in a fixed axial position, and cooperates with the axially-translatable lens system mounted on the moveable lens carriage 14 so that beam divergence is varied due to the effect of moving the imaging lens system axially with respect to the multiple-lens array 60, lamp 1 and reflector 2. Alternatively, the combination of imaging lenses 7 and 8, and microlens 22 can be mounted in a fixed axial position while the multiple-lens array is mounted for axial movement with respect to the lamp and reflector.

Figure 13:
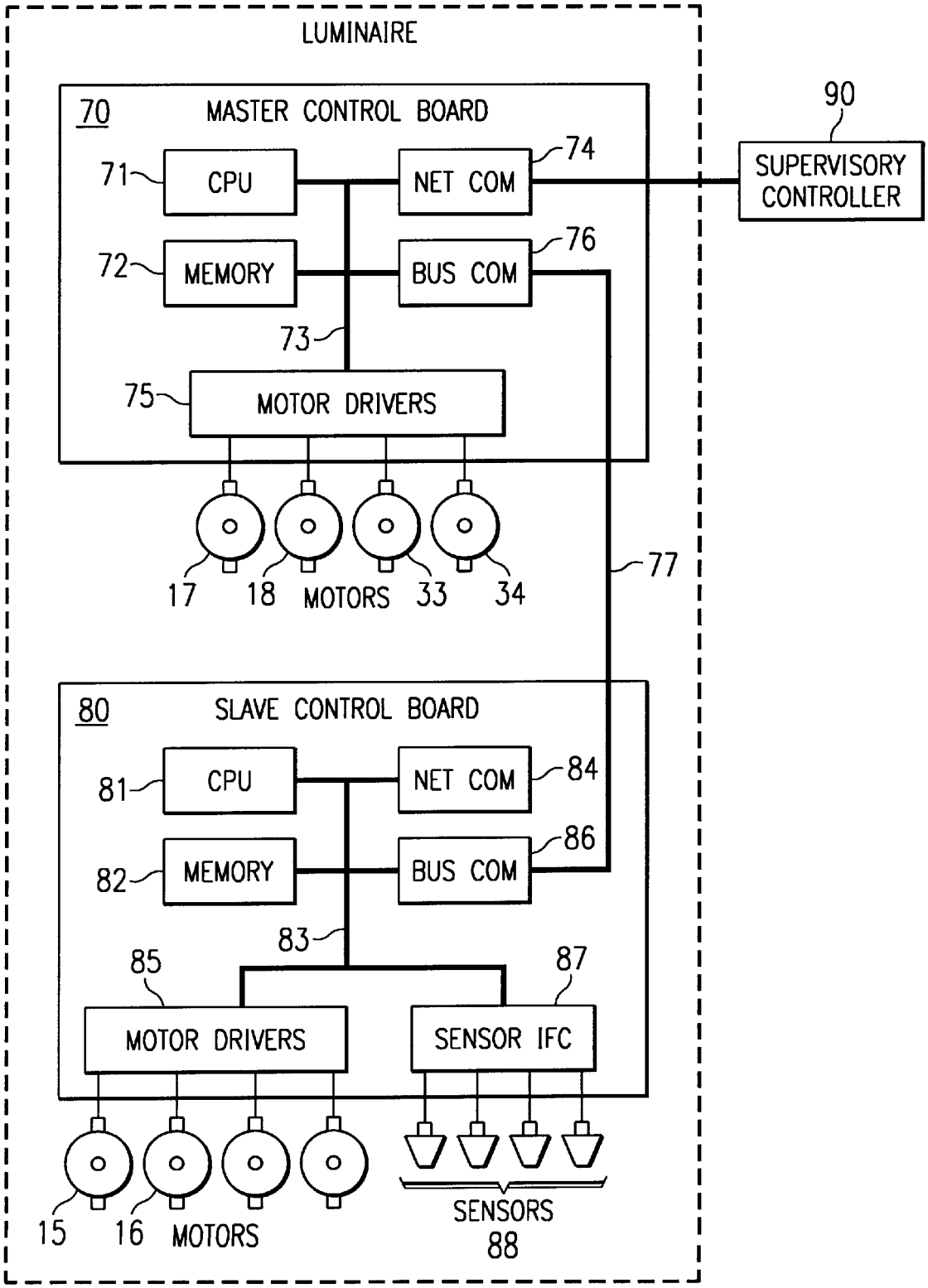
FIG. 13 is a schematic block diagram of an electronic control system.

Control electronics for the luminaire, as shown in FIG. 13, comprise a printed circuit board assembly 70 having a central processing unit (CPU) 71, preferably in the form of a microprocessor, and associated memory 72 therefor interconnected by a bus system 73 carrying address, data, and control signals. A communications circuit 74 coupled to the microprocessor via the bus system communicates with an external supervisory controller 90 for directing the operation of plural such luminaries. A motor-driver interface circuit 75 coupled to the microprocessor via the bus system 73 operates motors for adjusting the positions of the color wheel, the gobo wheel, and the pan and tilt or X-Y scanning motors. If additional motorized mechanisms are provided for adjusting the dimmer, adjustable iris, image-projecting lens system, and/or variable-diffusion multiple lens array, a second control board 80 is provided having a microprocessor 81, memory 82, and motor drivers 85. The two control boards are linked from serial bus communication link circuit 76 through the serial data link 77, which is internal to the luminaire, to the serial bus communication link circuit 86. The second, slave, controller is directed in operation by the first, master, controller. Commands received from the external, supervisory controller are relayed from the master control board via the internal serial data link 77 to the slave control board, which then executes the commands.

The motor systems may include DC servomotor systems, stepper motor systems, or a combination of both. Stopper motor systems can be driven "open-loop" or may be provided with position-detecting sensors 88 coupled to the control system via sensor interface 87. Techniques for operating motor systems of these types are shown, for example, in U.S. Pat. No. 4,980,806, which is hereby incorporated by reference.

We claim:

1. A lighting instrument comprising:

a light source optically coupled with a reflector, said light source and reflector projecting a light beam along an optical axis;

a variable light modifier supported by a motorized mechanism; and a housing at least partially enclosing said light source, said reflector, said variable light modifier and said motorized mechanism; said housing being configured to be substantially fully recessed into a ceiling, wall, or floor of a building; said housing including a light-pervious aperture in one surface thereof.

2. The lighting instrument of claim 1, further comprising a first frame supporting said light source and said reflector, a second frame supporting said first frame, said second frame being configured to mount within said housing, said first frame being hingedly attached to said second frame and operable to pivot partially out of said housing.

3. A lighting instrument, comprising:

a light source optically coupled with an elliptical reflector, said light source and reflector projecting a light beam along an optical axis, said light source being disposed near a primary focus of said reflector;

a field stop aperture disposed near a secondary focus of said reflector;

an axially-translatable, image-projecting lens system in combination with a microlens array, said microlens array being disposed downstream of said image-projecting lens system; and a housing at least partially enclosing said light source, said reflector, and said lens system.

4. The lighting instrument of claim 3, further comprising:

an X-Y scanning mirror system, including a substantially planar mirror intercepting said light beam and motors operable to move said mirror, said scanning mirror system being disposed along said optical axis and operable to redirect said light beam.

5. The lighting instrument of claim 4, further comprising a color-changing system.

6. The lighting instrument of claim 4, further comprising a multiple-lens array disposed along said optical axis between said field stop aperture and said image-projecting lens system.

7. The lighting instrument of claim 6, further comprising a housing at least partially enclosing said light source, said reflector, said lenses and said scanning mirror system; said housing being configured to be substantially fully recessed into a ceiling, wall, or floor of a building; said housing including a light-pervious aperture in one surface thereof.

8. The lighting instrument of claim 7, further comprising a first frame supporting said light source and said reflector, a second frame supporting said first frame, said second frame being configured to mount within said housing, said first frame being hingedly attached to said second frame and operable to pivot partially out of said housing.

9. The lighting instrument of claim 3, further comprising:

a motorized, panning and tilting yoke assembly supporting said light source, said reflector, and said lenses.

10. The lighting instrument of claim 9, further comprising a color-changing system.

11. The lighting instrument of claim 9, further comprising a multiple-lens array disposed along said optical axis between said field stop aperture and said image-projecting lens system.

12. The lighting instrument of claim 3, further comprising an electronic control system, said control system comprising:

a master control circuit board including a microprocessor, memory, motor-driver interface circuits, and a bus-driver/receiver communications circuit;

a slave control circuit board including motor-driver interface circuits and a bus-driver/receiver communications circuit; and a digital communications bus interconnecting said master control circuit board and said slave control circuit board.

13. The electronic control system of claim 12, further comprising a network communications circuit coupled to said microprocessor, said network communications circuit receiving luminaire control signals from a remote, supervisory controller.

14. The electronic control system of claim 12, further comprising sensor circuits coupled to said bus-driver/receiver communications circuit, said sensor circuits detecting at least one position of said motor-driven mechanisms.

15. A method for mounting a lighting instrument having at least one motorized mechanism for adjusting a variable light modifier; the method comprising the steps of:

installing a housing into a building structure, said housing being substantially fully recessed into said structure after installation therein;

routing electrical power wiring to said housing;

routing electrical control signal wiring to said housing;

installing a lighting instrument into said housing, said lighting instrument having a motorized mechanism for adjusting a variable light modifier of said lighting instrument;

connecting said electrical power wiring to said lighting instrument;

connecting said electrical control signal wiring to said lighting instrument; and installing a cover plate over said housing and said lighting instrument, said cover plate having a light beam exit aperture formed therein.

16. A lighting instrument comprising:

a means for providing a light beam along an optical axis;

a means for directing said light beam;

a means for at least partially enclosing said light source, said reflector, and said means for directing said light beam; said enclosing means being configured to be substantially fully recessed into a ceiling, wall, or floor of a building; said enclosing means including a light-pervious aperture in one surface thereof.

17. The lighting instrument of claim 1, wherein said variable light modifier comprises a mechanical light dimmer.

18. The lighting instrument of claim 1, wherein said variable light modifier comprises at least one set of color filters.

19. The lighting instrument of claim 1, wherein said variable light modifier comprises a beam-director system, including at least a first substantially planar mirror intercepting said light beam and at least a first motor operable to move said mirror, said beam-director system being disposed along said optical axis and operable to redirect said light beam.

20. The lighting instrument of claim 6, further comprising a mechanical dimmer.

21. The lighting instrument of claim 9, further comprising a mechanical dimmer.

22. The lighting instrument of claim 16, further comprising a dimmer.

23. The lighting instrument of claim 16, further comprising a color-changing system.

* * * * *